US010533397B2

(12) United States Patent
Fuxa et al.

(10) Patent No.: US 10,533,397 B2
(45) Date of Patent: Jan. 14, 2020

(54) BALL DROP TWO STAGE VALVE

(71) Applicants: Jason Fuxa, Houston, TX (US); Daniel J. Turick, Houston, TX (US); Michael Johnson, Katy, TX (US); Adriana Hightower, Cypress, TX (US); Joshua Raymond Snitkoff, Houston, TX (US); Nicholas Carrejo, Katy, TX (US); Tarik Abdelfattah, Houston, TX (US)

(72) Inventors: Jason Fuxa, Houston, TX (US); Daniel J. Turick, Houston, TX (US); Michael Johnson, Katy, TX (US); Adriana Hightower, Cypress, TX (US); Joshua Raymond Snitkoff, Houston, TX (US); Nicholas Carrejo, Katy, TX (US); Tarik Abdelfattah, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 195 days.

(21) Appl. No.: 15/724,494

(22) Filed: Oct. 4, 2017

(65) Prior Publication Data

US 2019/0100980 A1 Apr. 4, 2019

(51) Int. Cl.
*E21B 21/14* (2006.01)
*E21B 34/14* (2006.01)
(Continued)

(52) U.S. Cl.
CPC ..... *E21B 34/14* (2013.01); *E21B 21/14* (2013.01); *E21B 43/255* (2013.01); *E21B 2034/007* (2013.01)

(58) Field of Classification Search
CPC .... E21B 2034/007; E21B 21/14; E21B 34/14; E21B 43/255
See application file for complete search history.

(56) References Cited

U.S. PATENT DOCUMENTS 8,555,983 B2 * 10/2013 Palacios ..... E21B 23/04 166/316
8,978,773 B2 * 3/2015 Tilley ..... E21B 34/14 166/351

(Continued)

FOREIGN PATENT DOCUMENTS

EP 2360347 A2 8/2011
WO WO2014142849 A1 9/2014

OTHER PUBLICATIONS

International Search Report and Written Opinion for Intnemational Application No. PCT/US2018/049445; International Filing Date Sep. 5, 2018; Report dated Jan. 25, 2019 (pp. 1-15).

*Primary Examiner* — Daniel P Stephenson
(74) *Attorney, Agent, or Firm* — Cantor Colburn LLP

(57) ABSTRACT

A ball drop two stage valve includes a tubular having a body defined by an outer surface and an inner surface that defines a fluid flow path. A stimulation port is formed in the body. The stimulation port extends through the body. At least one flow port is formed in the body longitudinally spaced from the stimulation port. The at least one flow port extends through the body. A first sleeve is slidingly positioned along the fluid flow path in the body. The first sleeve includes a first ball seat and is selectively positionable to selectively block flow through the stimulation port. A second sleeve is slidingly positioned along the fluid flow path in the body. The second sleeve includes a second ball seat and is selectively positionable to selectively block flow through the flow port and the stimulation port.

16 Claims, 5 Drawing Sheets

(51) Int. Cl.
*E21B 43/25* (2006.01)
*E21B 34/00* (2006.01)

(56) References Cited

U.S. PATENT DOCUMENTS

| | | | | |
|---|---|---|---|---|
| 9,187,994 | B2 * | 11/2015 | Themig | E21B 34/103 |
| 9,279,312 | B2 * | 3/2016 | King | E21B 34/06 |
| 2009/0056934 | A1 * | 3/2009 | Xu | E21B 43/26 166/244.1 |
| 2009/0056952 | A1 * | 3/2009 | Churchill | E21B 21/10 166/373 |
| 2010/0044041 | A1 * | 2/2010 | Smith | E21B 34/14 166/280.1 |
| 2011/0030976 | A1 * | 2/2011 | King | E21B 23/04 166/387 |
| 2011/0100643 | A1 * | 5/2011 | Themig | E21B 34/102 166/373 |
| 2011/0100647 | A1 * | 5/2011 | King | E21B 34/14 166/386 |
| 2011/0192613 | A1 * | 8/2011 | Garcia | E21B 23/08 166/373 |
| 2011/0278017 | A1 * | 11/2011 | Themig | E21B 34/14 166/373 |
| 2015/0159469 | A1 * | 6/2015 | Purkis | E21B 23/04 166/373 |
| 2019/0100980 | A1 * | 4/2019 | Fuxa | E21B 34/14 |

* cited by examiner

BALL DROP TWO STAGE VALVE

BACKGROUND

In the resource exploration and recovery industry, various flow control devices are employed to guide fluid into and receive fluid from a formation. Stimulation fluids may be passed from a tubular and introduced into a formation to promote increased inflow and/or outflow from a reservoir such as fracking. Alternatively, stimulation fluids may include acids. After the introduction of stimulation fluids, production fluids may be received by the tubular or injection fluids may be pumped through the tubular. Thus, after stimulation it is often desirable to open a passageway between the formation and the tubular. Typically, a tool, such as coiled tubing, is introduced into the tubular to open pathways that may deliver fluid to and receive fluid from the formation. The use of coiled tubing increases operational costs and downtime. The art would be open to new, less costly and time consuming systems for opening fluidic pathways between a tubular and a formation.

SUMMARY

Disclosed is a ball drop two stage valve including a tubular having a body defined by an outer surface and an inner surface that defines a fluid flow path. At least one stimulation port is formed in the body. The at least one stimulation port extends through the outer surface and the inner surface. At least one flow port is formed in the body longitudinally spaced from the at least one stimulation port. The at least one flow port extends through the outer surface and the inner surface. A first sleeve is slidingly positioned along the fluid flow path in the body. The first sleeve includes a first ball seat and is selectively positionable to selectively block flow through the at least one stimulation port. A second sleeve is slidingly positioned along the fluid flow path in the body. The second sleeve includes a second ball seat and is selectively positionable to selectively block flow through the at least one flow port and the at least one stimulation port.

Also disclosed is a resource recovery and exploration system including a first system, and a second system including a string of tubulars. At least one of the string of tubulars includes a ball drop two stage valve including a body having an outer surface and an inner surface that defines a fluid flow path. At least one stimulation port is formed in the body. The at least one stimulation port extends through the outer surface and the inner surface. At least one flow port is formed in the body longitudinally spaced from the at least one stimulation port. The at least one flow port extends through the outer surface and the inner surface. A first sleeve is slidingly positioned along the fluid flow path in the body. The first sleeve includes a first ball seat and is selectively positionable to selectively block flow through the at least one stimulation port. A second sleeve is slidingly positioned along the fluid flow path in the body. The second sleeve includes a second ball seat and is selectively positionable to selectively block flow through the at least one flow port and the at least one stimulation port.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
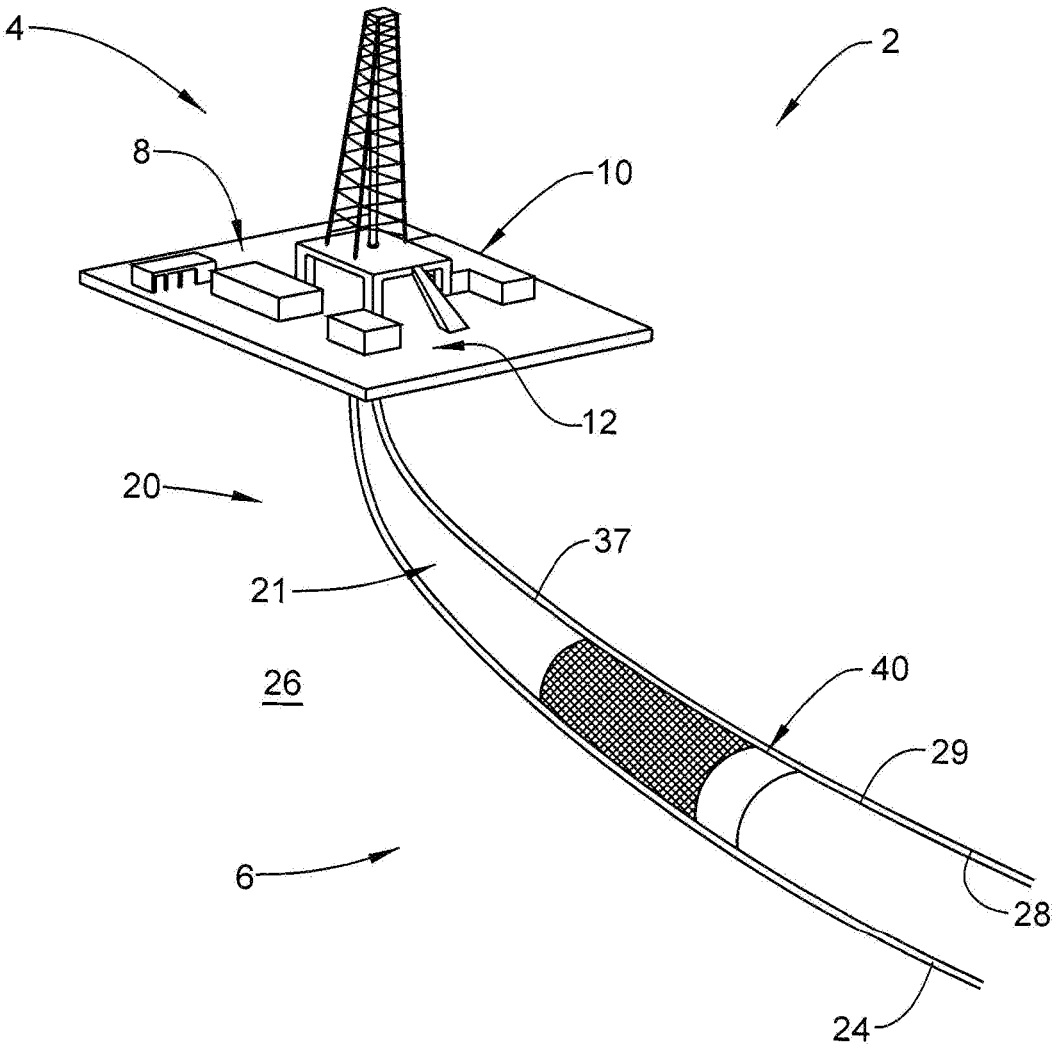
FIG. 1 depicts a resource exploration and recovery system including a ball drop two stage valve, in accordance with an aspect of an exemplary embodiment.

A resource exploration and recovery system, in accordance with an exemplary embodiment, is indicated generally at 2, in FIG. 1. Resource exploration and recovery system 2 should be understood to include well drilling operations, resource extraction and recovery, $CO_2$ sequestration, and the like. Resource exploration and recovery system 2 may include a first system 4 which, in some environments, may take the form of a surface system operatively and fluidically connected to a second system 6 which, in some environments, may take the form of a downhole system. First system 4 may include pumps 8 that aid in completion and/or extraction processes as well as fluid storage 10. Fluid storage 10 may contain a stimulation fluid which may be introduced into downhole system 6. First system 4 may also include a control system 12 that may monitor and/or activate one or more downhole operations.

Second system 6 may include a tubular string 20 formed from a plurality of tubulars, one of which is indicated at 21 that is extended into a wellbore 24 formed in formation 26. Wellbore 24 includes an annular wall 28. Tubular string 20 may include a ball drop two stage valve 40 that facilitates the introduction of stimulation fluids and/or injection fluids into formation 26 and the delivery of formation fluids from formation 26 to first system 4 as will be detailed herein.

Figure 2:
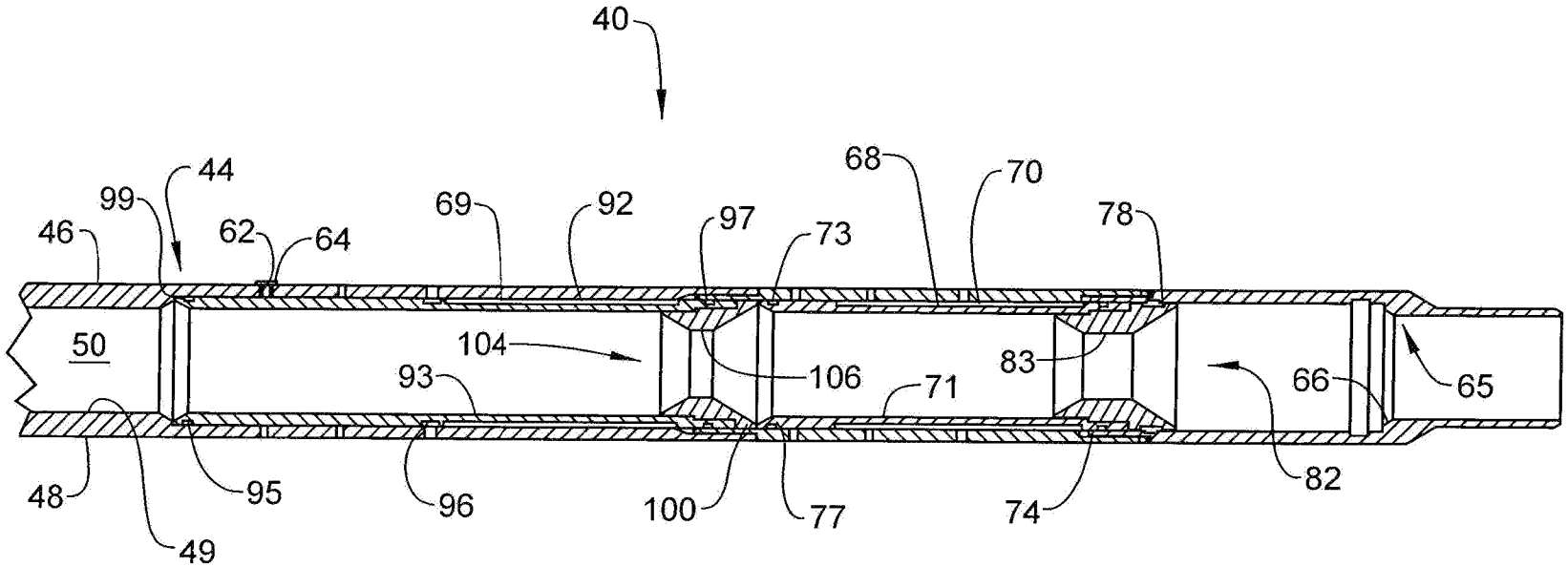
FIG. 2 depicts the ball drop two stage valve configured to be run into a formation, in accordance with an aspect of an exemplary embodiment.

Referring to FIG. 2 and with continued reference to FIG. 1, ball drop two stage valve 40 includes a tubular 44 having a body 46. Body 46 includes an outer surface 48 and an inner surface 49 that defines a fluid flow path 50. Body 46 includes a plurality of stimulation ports, one of which is indicated at 54 that extend through outer surface 48 and inner surface 49. Stimulation ports 54 provide a pathway for stimulation fluids to flow from tubular string 20 into formation 26.

Each of the plurality of stimulation ports 54 includes a longitudinal dimension that extends along a length of tubular 44 and a radial dimension that extends along a circumference of tubular 44. In the exemplary embodiment shown, stimulation ports 54 take the form of elongated slots 58. It should, however, be understood that stimulation ports 54 may possess a wide array of geometries. Body 46 also includes one or more flow ports 62 (FIG. 3) that provide a flow path for downhole fluids to enter tubular string 20. Flow ports 62 may include an inflow control device (ICD) 64 that controls an inflow pressure and/or velocity of the downhole fluids. ICD 64 may filter production fluids or, may be selectively adjustable so as to selectively control an inflow fluid velocity. Body 46 is also shown to include an annular ledge 65 formed on inner surface 49. Annular ledge 65 defines a travel limiter 66 as will be detailed herein.

In accordance with an aspect of an exemplary embodiment, ball drop two stage valve 40 includes a first sleeve 68 slideably arranged within fluid flow path 50 and a second sleeve 69 arranged adjacent first sleeve 68. Second sleeve 69 is also slideably disposed along fluid flow path 50. First sleeve 68 includes an outer surface section 70 and an inner surface section 71. Outer surface section 70 supports a first O-ring seal 73 and a second O-ring seal 74 that seal against inner surface 49 of tubular 44. First sleeve 68 includes a first end portion 77 and a second end portion 78. First end portion 77 defines a travel limiter portion 80 (FIG. 3) as will be detailed herein. First sleeve 68 also includes a first ball seat 82 having a first diameter 83. It should be understood that while shown in a single tubular, first sleeve 68 and second sleeve 69 may be arranged in separate tubulars connected to tubular string 20.

Second sleeve 69 includes an outer surface portion 92 and an inner surface portion 93. Outer surface portion 92 supports a first O-ring seal 95, a second O-ring seal 96, and a third O-ring seal 97 that seal against inner surface 49. Second sleeve 69 includes a first end section 99 and a second end section 100. Second sleeve 69 also includes a second ball seat 104 having a second diameter 106. In the exemplary aspect shown, second diameter 106 is larger than first diameter 83. However, it should be understood that first and second diameters 83 and 106 may be of substantially equal size. It should also be understood that first and second sleeves 68 and 69 are part of the same tool, e.g., body 46.

Figure 3:
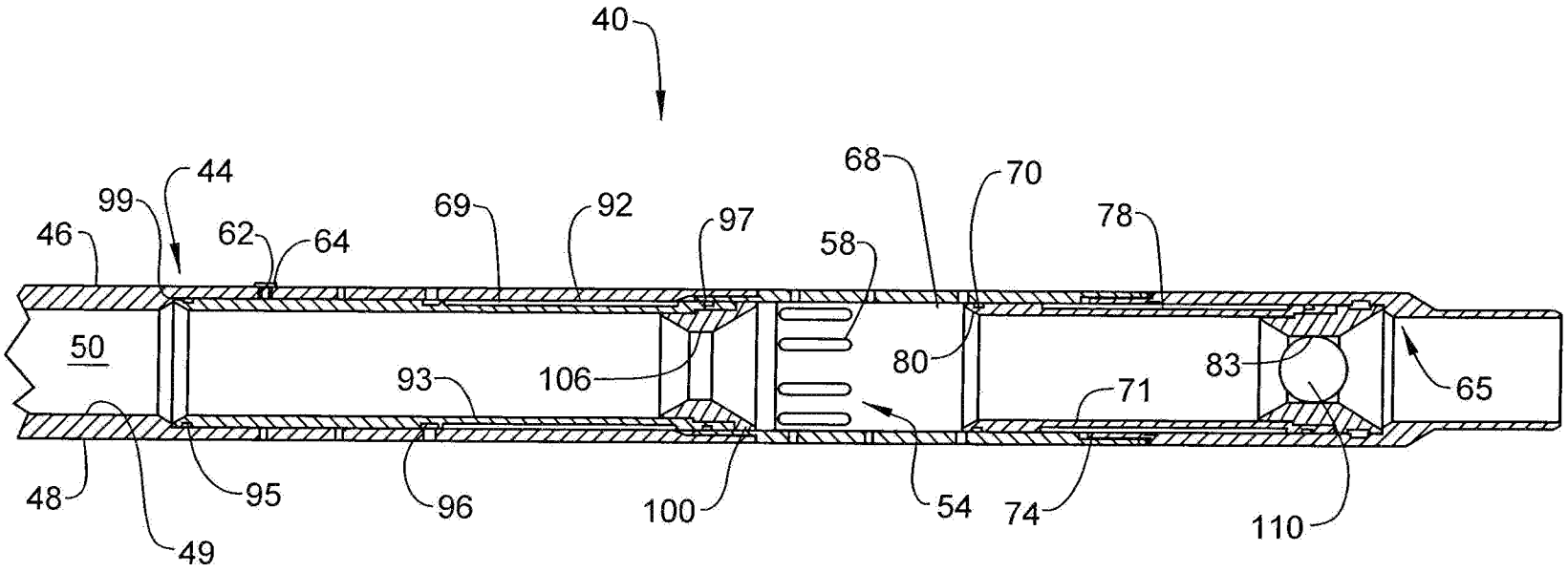
FIG. 3 depicts the ball drop two stage valve configured for stimulation, in accordance with an aspect of an exemplary embodiment.

In accordance with an aspect of an exemplary embodiment, ball drop two stage valve 40 may be run in to formation 26 with stimulation ports 54 and flow ports 62 closed by respective ones of first and second sleeves 68 and 69 as shown in FIG. 2. Prior to stimulating formation 26, a first ball 110 is introduced into tubular string 20 and pumped down to first ball seat 82. Fluid pressure is applied to first ball 110 causing first sleeve 68 to transition toward travel limiter 66 as shown in FIG. 3. Specifically, first sleeve 68 may be shifted in a downhole direction until first end portion 77 contacts travel limiter 66. At this point, stimulation fluids may be passed into tubular string 20 and pumped through stimulation ports 54 to stimulate formation 26.

Figure 4:
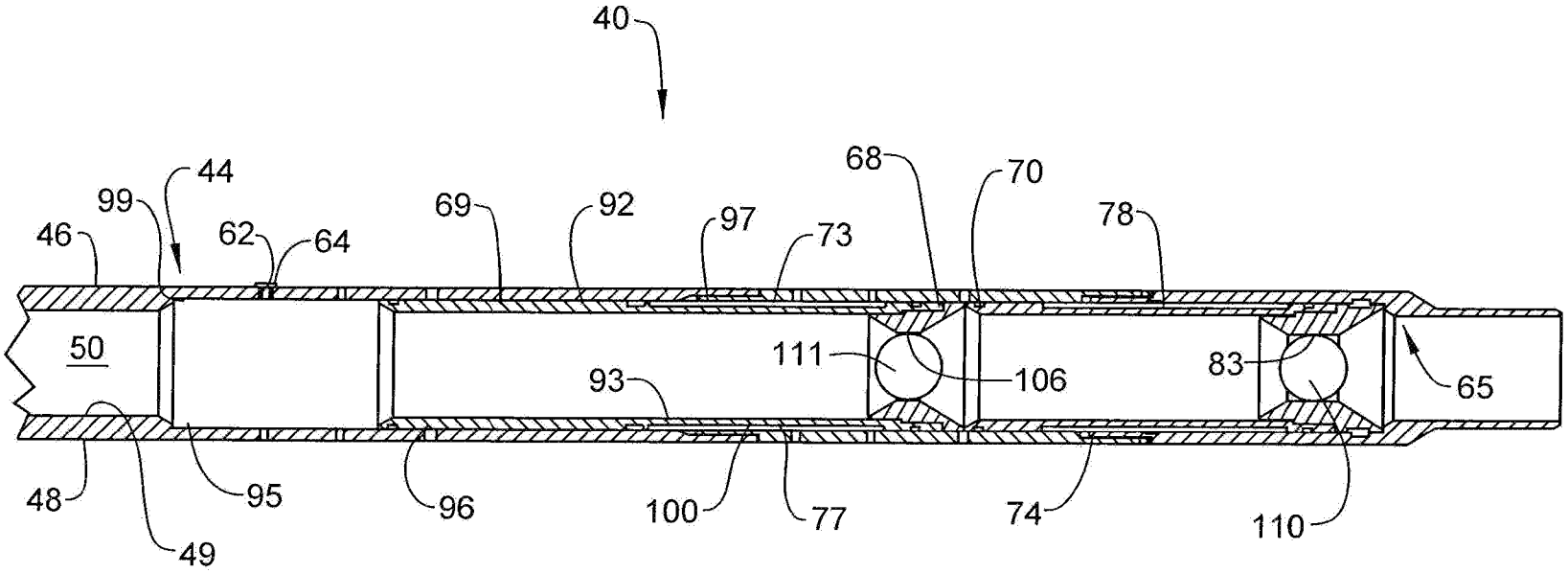
FIG. 4 depicts the ball drop two stage valve configured for production/injection, in accordance with an aspect of an exemplary embodiment.
Figure 5:
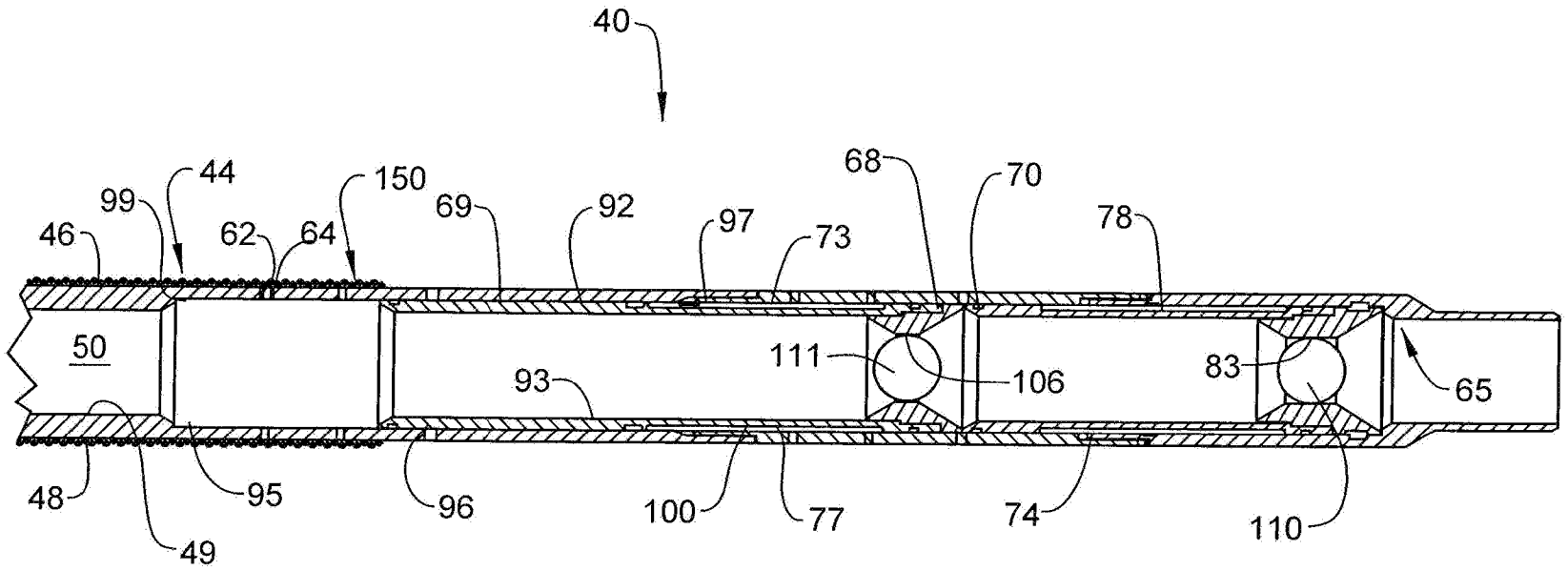
FIG. 5 depicts a ball drop two stage valve, in accordance with another aspect of an exemplary embodiment.

After stimulating formation 26, it may be desirable to produce or recover downhole fluids from formation 26 or alternately inject fluids into formation 26 in a controlled manner. Thus, after stimulation, a second ball 111 is introduced into tubular string 20 and pumped down to second ball seat 104. Additional pressure is applied, causing first end section 99 of second sleeve 69 to come into contact with travel limiter portion 80 of first sleeve 68 as shown in FIG. 4. At this point, second sleeve 69 closes stimulation ports 54 and uncovers flow ports 62 allowing alternate fluidic communication between tubular string 20 and formation 26. In accordance with an exemplary aspect of control associated with flow ports 62, the downhole fluids may pass through a screen assembly 150 provided on ball drop two stage valve 40 prior to entering flow ports 62. Alternatively, it should be understood that a single ball may be introduced into tubular string 20, pumped down to second ball seat 104, and pressured up to slide both first sleeve 68 and second sleeve 69 to open flow port 62.

Set forth below are some embodiments of the foregoing disclosure:

Embodiment 1

A ball drop two stage valve comprising a tubular including a body having an outer surface and an inner surface that defines a fluid flow path at least one stimulation port formed in the body, the at least one stimulation port extending through the outer surface and the inner surface, at least one flow port formed in the body longitudinally spaced from the at least one stimulation port, the at least one flow port extending through the outer surface and the inner surface, a first sleeve slidingly positioned along the fluid flow path in the body, the first sleeve including a first ball seat and being selectively positionable to selectively block flow through the at least one stimulation port, and a second sleeve slidingly positioned along the fluid flow path in the body, the second sleeve including a second ball seat and being selectively positionable to selectively block flow through the at least one flow port and the at least one stimulation port.

Embodiment 2

The ball drop two stage valve according to any prior embodiment, wherein the at least one flow port is arranged upstream of the at least one stimulation port.

Embodiment 3

The ball drop two stage valve according to any prior embodiment, wherein the body includes an annular ledge formed on the inner surface, the annular ledge defining a travel limiter for the first sleeve.

Embodiment 4

The ball drop two stage valve according to any prior embodiment, wherein the first ball seat includes a first diameter and the second ball seat includes a second diameter, the first diameter being distinct from the first diameter.

Embodiment 5

The ball drop two stage valve according to any prior embodiment, wherein the first diameter is smaller than the second diameter.

Embodiment 6

The ball drop two stage valve according to any prior embodiment, wherein the first sleeve includes a first end portion and a second end portion, the first end portion providing a travel limiter portion for the second sleeve.

Embodiment 7

The ball drop two stage valve according to any prior embodiment, wherein the at least one stimulation port includes a plurality of stimulation ports, each of the plurality of stimulation ports including a longitudinal dimension that is greater than a radial dimension.

Embodiment 8

The ball drop two stage valve according to any prior embodiment, further comprising a flow control device arranged in the flow port.

Embodiment 9

The ball drop two stage valve according to any prior embodiment, wherein the flow control device comprises a selectively controllable inflow control device (ICD).

Embodiment 10

A resource recovery and exploration system comprising a first system, a second system including a string of tubulars, at least one of the string of tubulars including a ball drop two stage valve comprising a body having an outer surface and an inner surface that defines a fluid flow path, at least one stimulation port formed in the body, the at least one stimulation port extending through the outer surface and the inner surface, at least one flow port formed in the body longitudinally spaced from the at least one stimulation port, the at least one flow port extending through the outer surface and the inner surface, a first sleeve slidingly positioned along the fluid flow path in the body, the first sleeve including a first ball seat and being selectively positionable to selectively block flow through the at least one stimulation port; and a second sleeve slidingly positioned along the fluid flow path in the body, the second sleeve including a second ball seat and being selectively positionable to selectively block flow through the at least one flow port and the at least one stimulation port.

Embodiment 11

The resource recovery and exploration system according to any prior embodiment, wherein the at least one flow port is arranged upstream of the at least one stimulation port.

Embodiment 12

The resource recovery and exploration system according to any prior embodiment, wherein the body includes an annular ledge formed on the inner surface, the annular ledge defining a travel limiter for the first sleeve.

Embodiment 13

The resource recovery and exploration system according to any prior embodiment, wherein the first ball seat includes a first diameter and the second ball seat includes a second diameter, the first diameter being distinct from the first diameter.

Embodiment 14

The resource recovery and exploration system according to any prior embodiment, wherein the first diameter is smaller than the second diameter.

Embodiment 15

The resource recovery and exploration system according to any prior embodiment, wherein the first sleeve includes a first end portion and a second end portion, the first end portion providing a travel limiter portion for the second sleeve.

Embodiment 16

The resource recovery and exploration system according to any prior embodiment, wherein the at least one stimulation port includes a plurality of stimulation ports, each of the plurality of stimulation ports including a longitudinal dimension that is greater than a radial dimension.

Embodiment 17

The resource recovery and exploration system according to any prior embodiment, wherein the at least one flow port includes a flow control device.

Embodiment 18

The resource recovery and exploration system according to any prior embodiment, wherein the flow control device comprises a selectively controllable inflow control device (ICD).

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A ball drop two stage valve comprising:

a tubular including a body having an outer surface and an inner surface that defines a fluid flow path;

at least one stimulation port formed in the body, the at least one stimulation port extending through the outer surface and the inner surface;

at least one flow port formed in the body longitudinally spaced upstream from the at least one stimulation port, the at least one flow port extending through the outer surface and the inner surface;

a first sleeve slidingly positioned along the fluid flow path in the body, the first sleeve including a first ball seat and being selectively positionable to selectively block flow through the at least one stimulation port; and a second sleeve slidingly positioned along the fluid flow path in the body, the second sleeve including a second ball seat and being selectively positionable to selectively block flow through the at least one flow port and the at least one stimulation port.

2. The ball drop two stage valve according to claim 1, wherein the body includes an annular ledge formed on the inner surface, the annular ledge defining a travel limiter for the first sleeve.

3. The ball drop two stage valve according to claim 1, wherein the first ball seat includes a first diameter and the second ball seat includes a second diameter, the first diameter being distinct from the first diameter.

4. The ball drop two stage valve according to claim 3, wherein the first diameter is smaller than the second diameter.

5. The ball drop two stage valve according to claim 1, wherein the first sleeve includes a first end portion and a second end portion, the first end portion providing a travel limiter portion for the second sleeve.

6. The ball drop two stage valve according to claim 1, wherein the at least one stimulation port includes a plurality of stimulation ports, each of the plurality of stimulation ports including a longitudinal dimension that is greater than a radial dimension.

7. The ball drop two stage valve according to claim 1, further comprising: a flow control device arranged in the flow port.

8. The ball drop two stage valve according to claim 1, wherein the at least one flow port comprises a selectively controllable inflow control device (ICD).

9. A resource recovery and exploration system comprising:

a first system;

a second system including a string of tubulars, at least one of the string of tubulars including a ball drop two stage valve comprising:

a body having an outer surface and an inner surface that defines a fluid flow path;

at least one stimulation port formed in the body, the at least one stimulation port extending through the outer surface and the inner surface;

at least one flow port formed in the body longitudinally spaced upstream from the at least one stimulation port, the at least one flow port extending through the outer surface and the inner surface;

a first sleeve slidingly positioned along the fluid flow path in the body, the first sleeve including a first ball seat and being selectively positionable to selectively block flow through the at least one stimulation port; and a second sleeve slidingly positioned along the fluid flow path in the body, the second sleeve including a second ball seat and being selectively positionable to selectively block flow through the at least one flow port and the at least one stimulation port.

10. The resource recovery and exploration system according to claim 9, wherein the body includes an annular ledge formed on the inner surface, the annular ledge defining a travel limiter for the first sleeve.

11. The resource recovery and exploration system according to claim 9, wherein the first ball seat includes a first diameter and the second ball seat includes a second diameter, the first diameter being distinct from the first diameter.

12. The resource recovery and exploration system according to claim 11, wherein the first diameter is smaller than the second diameter.

13. The resource recovery and exploration system according to claim 9, wherein the first sleeve includes a first end portion and a second end portion, the first end portion providing a travel limiter portion for the second sleeve.

14. The resource recovery and exploration system according to claim 9, wherein the at least one stimulation port includes a plurality of stimulation ports, each of the plurality of stimulation ports including a longitudinal dimension that is greater than a radial dimension.

15. The resource recovery and exploration system according to claim 9, wherein the at least one flow port includes a flow control device.

16. The resource recovery and exploration system according to claim 15, wherein the flow control device comprises a selectively controllable inflow control device (ICD).

* * * * *